US009486116B2

(12) United States Patent
Caldwell

(10) Patent No.: US 9,486,116 B2
(45) Date of Patent: Nov. 8, 2016

(54) DISPENSER FOR ROLLED PRODUCT

(76) Inventor: Mark A. Caldwell, Lookout Mountain, TN (US)

( * ) Notice: Subject to any disclaimer, the term of this patent is extended or adjusted under 35 U.S.C. 154(b) by 171 days.

(21) Appl. No.: 13/370,162

(22) Filed: Feb. 9, 2012

(65) Prior Publication Data

US 2012/0211587 A1 Aug. 23, 2012

Related U.S. Application Data

(60) Provisional application No. 61/445,112, filed on Feb. 22, 2011.

(51) Int. Cl.

| | |
|---|---|
| ***A47K 10/38*** | (2006.01) |
| ***B65H 49/26*** | (2006.01) |
| ***B65H 49/32*** | (2006.01) |
| *A47K 10/32* | (2006.01) |
| *A47K 10/36* | (2006.01) |

(52) U.S. Cl.

CPC ..... *A47K 10/38* (2013.01); *B65H 49/26* (2013.01); *B65H 49/322* (2013.01); *B65H 49/325* (2013.01); *A47K 2010/3233* (2013.01); *A47K 2010/3681* (2013.01)

(58) Field of Classification Search

CPC ..... A47K 10/18; A47K 10/22; A47K 10/24; A47K 10/32; A47K 10/38; A47K 10/40; A47K 10/405; A47K 2010/24; A47K 2010/32; A47K 2010/3233; A47K 2010/34; A47K 2010/36; A47K 2010/3681; A47K 2010/38

USPC ..... 242/598, 598.3, 598.5, 598.6, 588, 242/588.3, 588.6

See application file for complete search history.

(56) References Cited

U.S. PATENT DOCUMENTS

| | | | | |
|---|---|---|---|---|
| 1,664,392 | A * | 4/1928 | Baruch | 242/422.5 |
| 2,229,560 | A * | 1/1941 | Froelich | B65H 35/0006 242/598.4 |
| 3,047,138 | A * | 7/1962 | Anderson, Jr. | 242/588.4 |
| 3,523,653 | A * | 8/1970 | Hansen | 242/593 |
| 3,739,964 | A * | 6/1973 | Stine | 225/47 |
| 4,759,510 | A | 7/1988 | Singer | |
| 4,763,786 | A * | 8/1988 | Benz | 242/588.6 |
| 5,228,632 | A * | 7/1993 | Addison et al. | 242/588.2 |
| 5,494,218 | A | 2/1996 | Armand | |

(Continued)

FOREIGN PATENT DOCUMENTS

WO 9825848 6/1998

OTHER PUBLICATIONS

"Paper Pot" from Molla Space: Design and Art of Lifestyle, http://www.mollaspace.com/shop/paper-pot-6.html, accessed Apr. 30, 2013.

(Continued)

*Primary Examiner* — Michael Mansen
*Assistant Examiner* — Nathaniel Adams

(57) ABSTRACT

There is provided herein a dispenser for a rolled product which has a center bore, comprising: a casing having walls and having a top with an opening; a first fastening means disposed on a first inner wall of said casing; a second fastening means disposed on a second inner wall of said casing, wherein said first inner wall is opposite said second inner wall, and said first fastening means is opposite said second fastening means; and an axle fastened to said first and second fastening means, wherein said axle can rotate when fastened.

16 Claims, 6 Drawing Sheets

(56) References Cited

U.S. PATENT DOCUMENTS

| | | | | |
|---|---|---|---|---|
| 5,582,362 | A | 12/1996 | Johnson et al. | |
| 5,718,404 | A * | 2/1998 | Greer | 248/309.2 |
| 5,785,274 | A | 7/1998 | Johnson | |
| 5,845,870 | A * | 12/1998 | Angle | 242/598.5 |
| 6,056,233 | A * | 5/2000 | Von Schenk | 242/594.5 |
| 6,405,972 | B1 | 6/2002 | Wakam | |
| 7,316,369 | B2 * | 1/2008 | Phelps | 242/596.4 |
| 7,416,153 | B1 | 8/2008 | Dervin | |
| 2002/0017572 | A1 | 2/2002 | Dobler et al. | |
| 2007/0040059 | A1 | 2/2007 | Kamenstein et al. | |
| 2008/0203215 | A1 | 8/2008 | Dervin | |
| 2010/0084503 | A1 | 4/2010 | Burgess | |
| 2010/0140372 | A1 | 6/2010 | Patrick | |
| 2010/0213303 | A1 | 8/2010 | Sanders | |

OTHER PUBLICATIONS

"Paper Pot: Modern Tissue or Toilet Paper Holder" from Apartment Therapy, http://www.apartmenttherapy.com/paper-pot-modern-tissue-or-toi-87554, accessed Apr. 30, 2013.

* cited by examiner

DISPENSER FOR ROLLED PRODUCT

PRIOR RELATED APPLICATIONS

This application claims priority to U.S. Ser. No. 61/445,112 filed Feb. 22, 2011, which is incorporated herein by reference in its entirety.

FEDERALLY SPONSORED RESEARCH STATEMENT

Not applicable.

FIELD OF THE INVENTION

The invention relates to a dispenser for rolled product, particularly to a toilet paper dispenser.

BACKGROUND OF THE INVENTION

Toilet paper is found in bathrooms all around the world. It is typically dispensed from a wall-mounted axle affixed near the commode. But toilet paper has more uses that just sanitary; for example, it can be used as a facial tissue. Thus, it is valuable to have a portable toilet paper dispenser that can be used anywhere, not just by the commode.

U.S. Pat. No. 6,405,972 describes a toilet paper storage device which can be used for storing or dispensing rolls of toilet paper. The device has a cover and a base. The base can be positioned against a vertical wall and the cover can either be slidingly removed or pivotally displaced from the base in order to gain access to the interior of the device. The device can incorporate a raised flat panel which is formed in the sidewall of the cover. The raised flat panel can be gripped with a single hand and facilitates ease of use by the elderly or a child.

Several publications describe a center-feed toilet paper dispenser, where the center tube has been removed and the toilet paper is drawn from the center of the roll, for example, WO199825848, U.S. Pat. No. 5,785,274 and U.S. Pat. No. 5,582,362.

What is lacking is a simple device for dispensing a rolled product, such as toilet paper, from the top of the device by unrolling the rolled product, avoiding the inconvenience and difficulty of removing the center tube from a rolled product before dispensing.

SUMMARY OF THE INVENTION

The device of this invention allows for easy dispensing of a rolled product, such as toilet paper, allowing one to take as much or as little as desired. There 85 sheets in a standard facial tissue box, but there 450 in a standard toilet roll. Using 3-4 sheets gives 150-112 uses per unit, 30-70% more uses than a standard box of facial tissue. Moreover, a standard toilet roll is significantly less expensive than facial tissue, providing an economic advantage to the user.

In particular, this application provides a dispenser for a rolled product which has a center bore, comprising: a casing having walls and having a top with an opening; a first fastening means disposed on a first inner wall of said casing; a second fastening means disposed on a second inner wall of said casing, wherein said first inner wall is opposite said second inner wall, and said first fastening means is opposite said second fastening means; and an axle fastened to said first and second fastening means, wherein said axle can rotate when fastened. The dispenser can further comprise a first guide disposed from near the bottom of said casing to said first fastening means, and a second guide disposed from near the bottom of said casing to said second fastening means, such that said axle can removably slide from the bottom of said guides into said fastening means.

The casing can have four walls. The fastening means can comprise indentations sized and shaped to receive the axle.

The axle can be telescoping and can be removed by contraction, for example, by comprising a spring. The axle can have a ridge near its end and can be removable by insertion of blade. The axle can have a sufficient diameter to substantially fill the bore of said rolled product. For example, the axle can comprise at least three bowed members spanning the middle of the axle and sized to fill the center bore of said rolled product, or the axle can comprise a foam sleeve sized to fill the center bore of the rolled product. The axle can also comprise a fragrance-bearing component.

In a particular aspect of this embodiment, this application provides a dispenser for a rolled product which has a center bore, comprising: a casing having four walls and having a top with an opening; a first fastening means disposed on a first inner wall of said casing; a second fastening means disposed on a second inner wall of said casing, wherein said first inner wall is opposite said second inner wall, and said first fastening means is opposite said second fastening means; an axle fastened to said first and second fastening means, wherein said axle can rotate when fastened, wherein said axle is telescoping and comprises a spring, and wherein said first and second fastening means comprise indentations sized and shaped to receive said axle; a first guide disposed from near the bottom of said casing to said first fastening means; and a second guide disposed from near the bottom of said casing to said second fastening means, such that said axle can removably slide from the bottom of said guides into said fastening means.

In some embodiments, there is provided a kit comprising: an axle; a first fastening means; a first guide attached to said first fastening means; a first adhesive covering the backside of said first fastening means and said first guide; a second fastening means; a second guide attached to said second fastening means; and a second adhesive covering the backside of said second fastening means and said second guide, wherein said first and second fastening means comprise indentations sized and shaped to receive said axle, and wherein said guides are shaped such that said axle can removably slide from the bottom of said guides into said fastening means and said axle rotate when fastened.

DESCRIPTION OF EMBODIMENTS OF THE INVENTION

Figure 1:
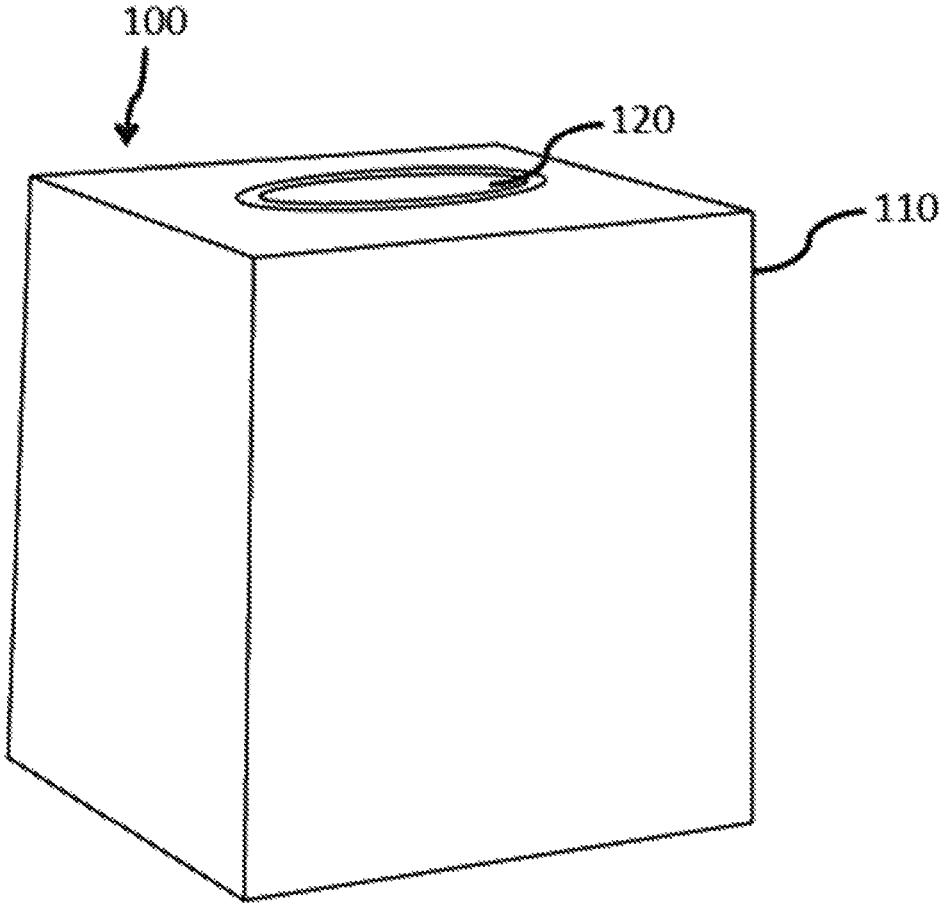
FIG. 1. Dispenser 100 comprising casing 110 and elliptical opening 120.
Figure 2:
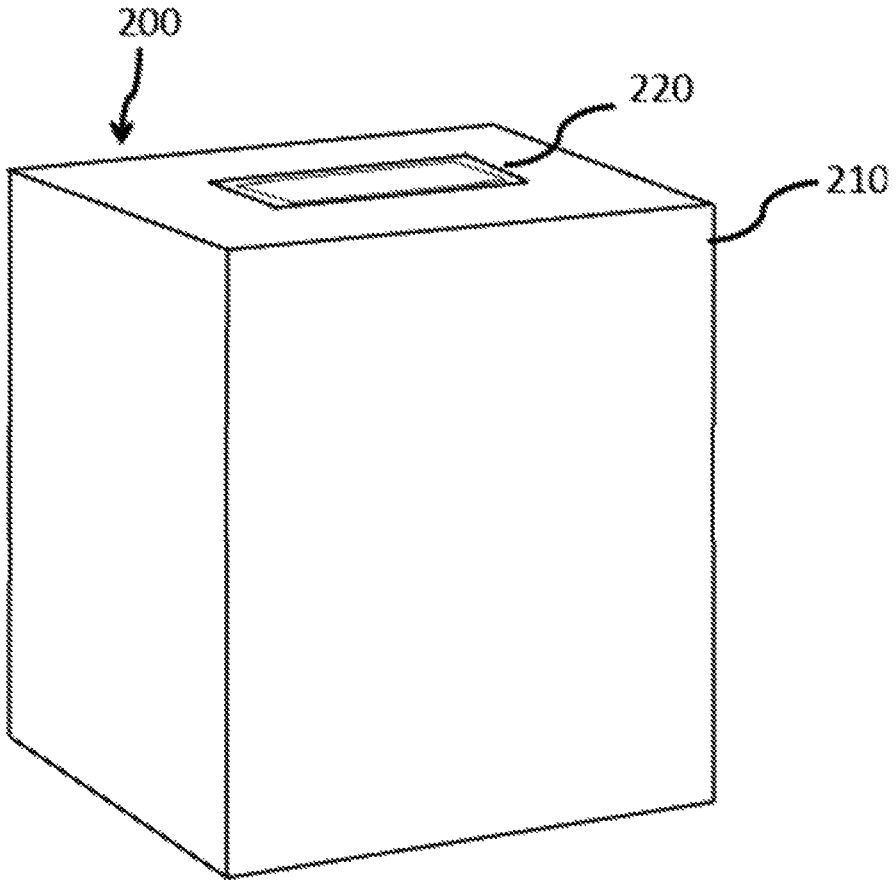
FIG. 2. Dispenser 200 comprising casing 210 and rectangular opening 220.

"Dispenser" refers to a container, package or device for holding and dealing out, distributing, apportioning, allotting, or allocating something in small amounts, for example segments or sheets of a rolled product.

"Rolled product" refers to product comprising a long strip of thin material continuously wrapped around a center rod, tube or bore. Rolled products include, but are not limited to, paper such as toilet paper or paper towels, moistened or wet wipes, tape such as masking tape, sheet plastic, plastic wrap (e.g. Saran™ wrap), foil, or the like.

In particular, a rolled product can be toilet paper. Toilet paper is generally soft, lightweight and/or sanitized, and can be used in bathrooms, for absorbing spillage or for craft projects, for personal cleanliness, and for removing or receiving fecal matter, urine, blood, pus, spit, snot, saliva, mucus, phlegm, sputum, expectoration and the like. Toilet paper can be referred to by a variety of colorful names, including, but not limited to, "bathroom tissue", "toilet tissue", "toilet roll", "loo paper", "loo roll", "dunny roll", "dunny paper", "dunny roll", "TP, "4 inch", or simply "tissue".

A typical unit for toilet paper is a roll, which includes about 500 perforated panels per standard roll (about 1000 sheets for a double roll) and a cardboard tube providing a central bore in the roll. A standard sized toilet paper roll is about 4-7 inches long (typically 4 inches) and about 4-5 inches in diameter. Some rolls do not contain a cardboard tube, but are nevertheless fashioned to function with an axle-containing dispenser and are, thus, also suitable for use with this invention.

Toilet paper products can vary immensely in the technical factors that distinguish them: sizes, weights, roughness, softness, chemical residues, "finger-breakthrough" resistance, water-absorption, etc. Toilet paper can be 1-ply, 2-ply, 3-ply or 4-ply, white or colored, scented or unscented. Toilet paper can be quilted, dimpled, rippled, embossed or treated with a humectant such as glycerin or a polyol to increase softness and/or durability. The toilet paper can also comprise a moisturizer, such as aloe, vitamin E, lotion and/or wax to reduce sensitivity and increase perceived softness. In particular, the toilet paper can be a standard roll, 2-ply, white and unscented.

"Casing", "covering" or "housing" refer to outer portion of the dispenser. The casing is fashioned from a suitably hard or durable material to support the fasteners, guides, axle of the dispenser, and the rolled product. The casing is sturdy or stable enough to allow the repeated pulling motion necessary to unroll a portion of the rolled product. The casing can be constructed from, for example, plastic, resin, wood, glass, ceramic, or the like. The casing can be any shape suitable for containing the dispensing apparatus and rolled product, for example, a box or cube. In some embodiments, the casing has four sides. In other embodiments, using the kit described herein, an existing casing, such as a facial tissue box cover, can be converted to a dispenser for a rolled product.

The casing has an opening on the top. This opening is large enough to accommodate the rolled product as it is unrolled. The opening can be any shape, such as a square, rectangle, circle, oval, ellipse, or slit. Examples of openings can be seen in FIGS. 1, 2, 6 and 7. The opening can be lined with a gasket or fringe made of, for example, felt, rubber or plastic, to reduce the amount of lint or dust generated by the rolled product as it is unrolled and to reduce the likelihood of the rolled product falling back into the dispenser. Preferably, the opening is sized such that the rolled product can be easily fed through the opening, but does not easily fall back into the casing. The opening can also comprise a hard ridge to facilitate tearing off a portion of the rolled product.

"Fastening means" or "fastener" refers to a mechanical means to join or affix two or more objects together, in particular, to rotatably join the casing with the axle so that the axle can suspend a rolled product and the axle can be easily inserted or removed from the casing. Fastening means can be, for example, a clamp, clasp, clip, clutch, flange, peg, pin, retaining ring, strap or tie. In a particular embodiment, the fastening means comprises an indentation sized and shaped to receive said axle, especially when the axle is shaped so that is locks or snaps into the fastening means, for example, as seen in FIG. 4, 5, 6 or 7.

Figure 5:
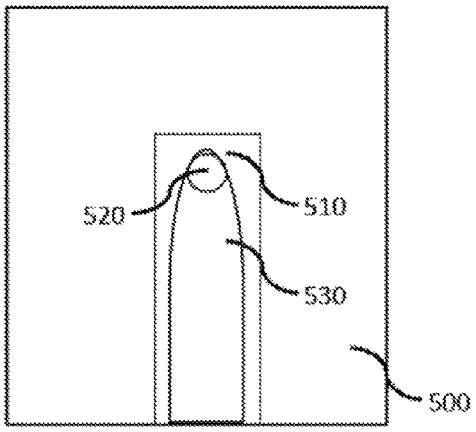
FIG. 5. View of an inner wall 500 of a dispenser having a fastener 510. The fastener 510 is has an indentation 520 shaped so that the fastener can receive an axle. Below fastener 510 is guide 530, which directs the axle from the bottom of the dispenser to indentation 520.
Figure 6:
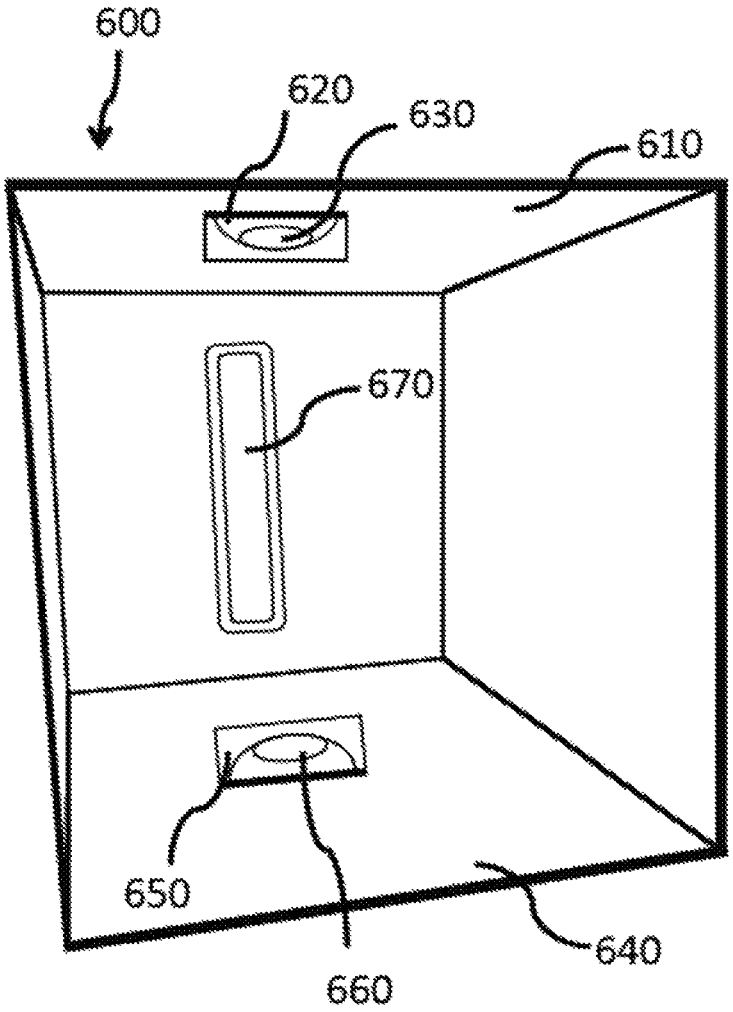
FIG. 6. View from the bottom of dispenser 600. A first inner wall 610 has a first fastener 620 with indentation 630. A second inner wall 640 has a second fastener 650 with indentation 660. The first inner wall 610 is directly opposite the second inner wall 640, and the first fastener 620 is opposite the second fastener 650. The casing has an ovoid opening 670 for access of the rolled product.
Figure 7:
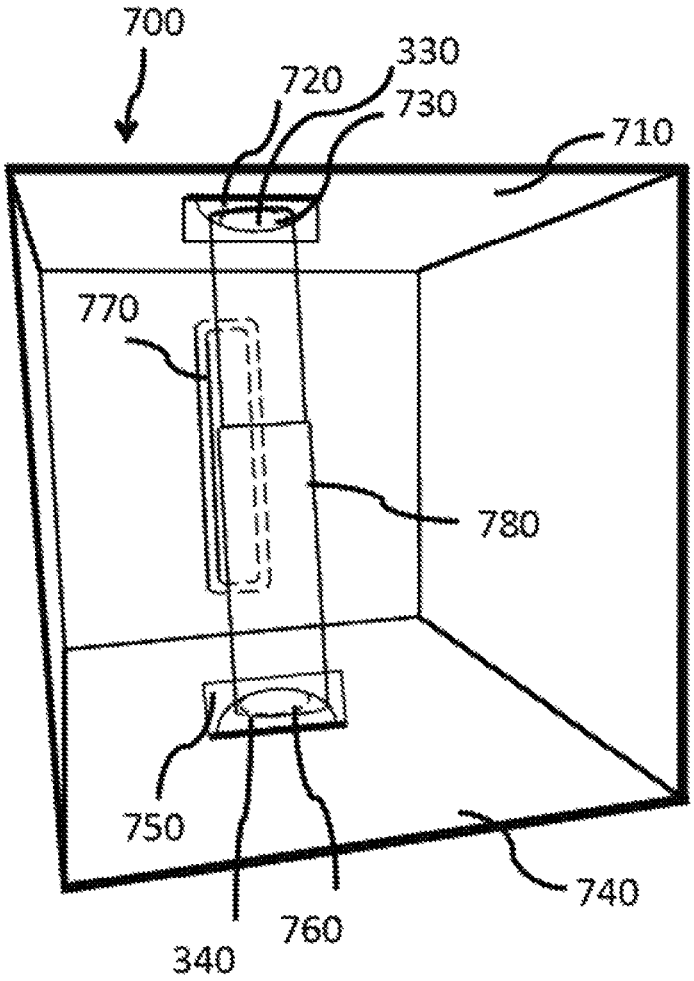
FIG. 7. View from the bottom of dispenser 700. A first inner wall 710 has a first fastener 720 with indentation 730. A second inner wall 740 has a second fastener 750 with indentation 760. The first inner wall 710 is directly opposite the second inner wall 740, and the first fastener 720 is opposite the second fastener 750. The casing has an ovoid opening 770 for access of the rolled product. Contractible axle 780 is inserted with nob 330 into first fastener 720 and with nob 340 into second fastener 750.
Figure 8:
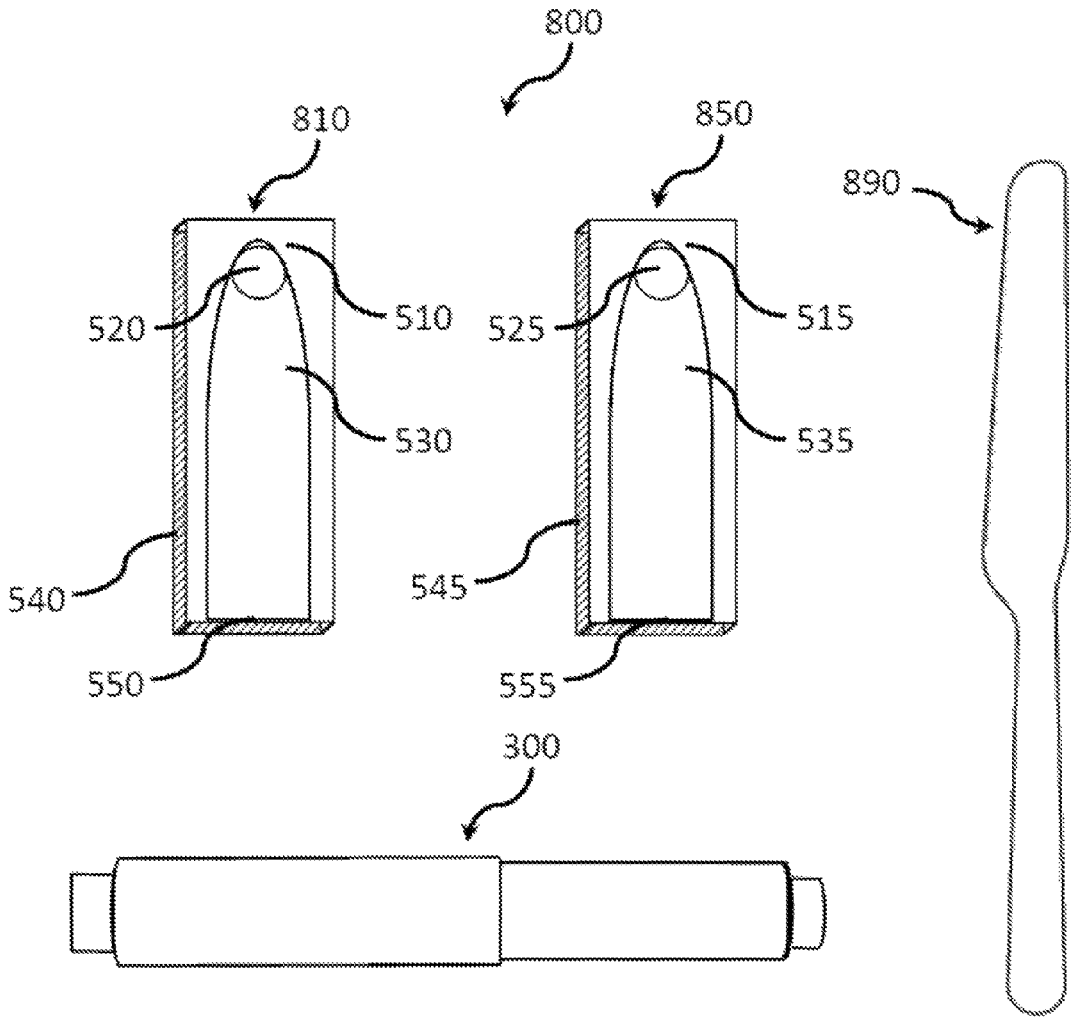
FIG. 8. Exploded view of a kit 800 for forming a dispenser from a casing, which is not part of the kit. The kit 800 comprises an axle 300. A first fastening means 810 is disposable on a first inner wall of the casing. A first guide 530 is attached to said first fastening means 810, wherein the first guide 530 has a bottom and first fastener 510 having an indentation 520. A first adhesive 540 covers the backside of said first fastening means 810 and said first guide 530. A second fastening means 850 is disposable on a second inner wall of the casing, wherein the first inner wall is opposite the second inner wall, and said first fastening means 810 is opposite said second fastening 850 means when the kit 800 is assembled. A second guide 535 is attached to said second fastening means 850, wherein the second guide 535 has a bottom 555, and a second fastener 515 with an indention 525. And a second adhesive 545 covers the backside of said second fastening means 550 and said second guide 535. The kit 800 is useable with a blade 890.

"Guide" refers to a slot, groove or track embedded in, embossed on, or attached an inner wall of the casing. The guide typically runs from the bottom or near the bottom of the casing to a fastening means, for example, as seen in FIG. 5. The groove is shaped such that the end of the axle is guided from the bottom of the casing to the fastening means, thereby facilitating installation and removal of the axle and/or rolled product. The guide can comprise a straight groove, or a groove that is wider at the bottom of the casing and gradually narrows or tappers as it reaches the fastening means.

"Axle", "spool" or "spindle" refers to a rod inserted through the bore of a rolled product and is used to suspend the roll between opposing interior walls of the casing. The axle is removable, meaning that it can be pushed into the fasteners and snapped, locked or fastened into place. The axle can then be subsequently pulled or popped out of the fasteners and removed from the casing. Typically, the axle comprises a feature, such as a narrowed section at the proximate and distal ends, which allows reception into the indentations of the fastening means. Fastening holds the axle into place so that the axle can rotate along its axis and allows the rolled product to be unrolled. Thus, fastening does not prevent the axle from rotating.

Figure 3:
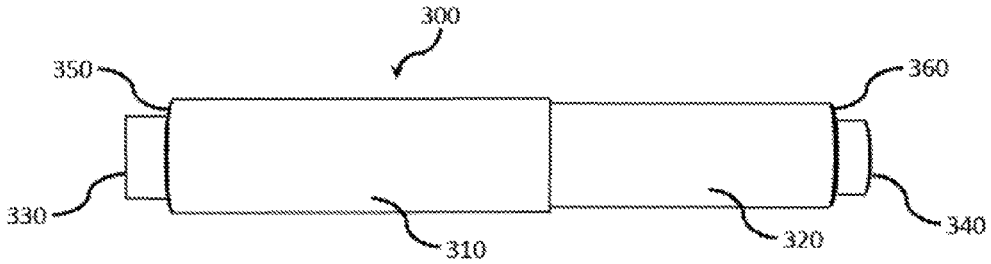
FIG. 3. Contractible axle 300 with segment 310 which can slide into segment 320 to reversibly shorten the length of the axle 300. Nobs 330 and 340 having ridges 350, 360 are sized and shaped so that they can fasten into the first and second fasteners of a dispenser.
Figure 4:
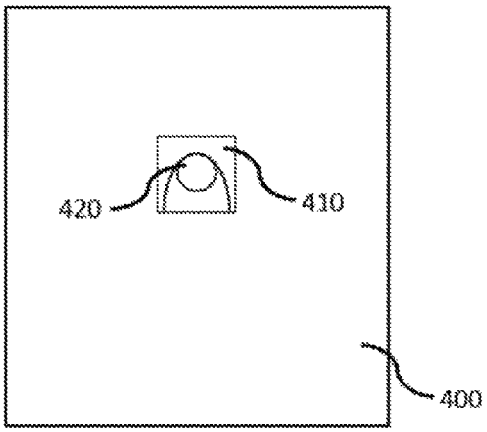
FIG. 4. View of an inner wall 400 of a dispenser having a fastener 410. The fastener 410 is shaped with an indentation 420 shaped so that the fastener can receive an axle.

The axle can be telescoping or contractible, for example, as described in U.S. Pat. No. 7,416,153 and US200802003215, or shown in FIG. 3. Such a contractible or telescoping axle can have a spring disposed therein. The axle can be sized so that it substantially fills the center bore of the rolled product. The axle can further comprise bowed members spanning the center of the axle. These bowed members flex to accommodate the bore of a rolled product, thereby firmly holding the roll onto the axle, for example, as described in US20070040059 and US20100213303. Alternatively, the axle can comprise a foam sleeve, which increases the diameter of the axle to substantially fill the center of the rolled product.

Optionally, the axle can further comprise a fragrance-bearing component which perfumes the air and/or the rolled product when rotated, for example, as described in US20100140372, US20020017572, U.S. Pat. No. 4,759,510 and U.S. Pat. No. 5,494,218. Also, the axle can comprise a mechanism, which causes it to rewind a predetermined amount after each use, for example, as described in US2010084503.

An axle with an extending piece on the end so that it is easier to squeeze the roll into place and squeeze the roll to remove it from the dispenser. The axle can also comprise a notch, ridge or indentation into which a knife-shaped tool or blade can be inserted to allow the easier insertion and removal of the axle and/or rolled product.

The kit referred to herein, comprises the components needed to convert a casing of appropriate size and dimensions to accommodate the fasteners, axle, and rolled product. In this kit, there is a matching pair of fastener-guide combinations coated with a suitable adhesive on their backsides; that is, on the side designed to contact the casing. Before application, the adhesive can have a removable film, such as a sheet of plastic or wax, to protect it from adhering to undesired surfaces before application to the casing of choice. In such case, the removable film is removed shortly before application of the fastener-guide combination. The kit can further comprise a knife-shaped tool or blade to allow the easier insertion and removal of the axle.

"Adhesive" or "glue" refers to a mixture in a liquid, semi-liquid, or solid state that adheres or bonds items together, for example a fastener and/or guide to an inner wall of a casing. Adhesive typically cure (harden) by either evaporating solvent or by chemical reaction that occurs between two or more constituents. Examples of adhesive include, but are not limited to, collagen-based adhesive, Canada balsam, gum arabic, latex, resorcinol resin, urea-formaldehyde resin, polystyrene/butanone cement, acrylonitrile, cyanoacrylate, acrylic, epoxy, ethylene-vinyl acetate, phenol formaldehyde resin, polyamide, polyester resin, polyethylene, polypropylene, polysulfide, polyurethane, polyvinyl acetate, polyvinyl chloride, polyvinylpyrrolidone, rubber cement and silicone.

Preferably, the adhesive is a pressure-sensitive adhesive, also referred to as "PSA", "self adhesive" or "self stick adhesive", which forms a bond when pressure is applied between the adhesive and the surface to which will bind. PSAs are typically based on an elastomer compounded with a suitable tackifier. Examples of elastomers include, but are not limited to, acrylics, butyl rubber, ethylene-vinyl acetate, natural rubber, nitrile, silicone rubber, styrene block copolymers, styrene-butadiene-styrene (SBS), styrene/ethylene/butylene-styrene (SEBS), styrene-ethylene/propylene (SEP), and styrene-isoprene-styrene (SIS). Tackifiers increase tack, or stickiness, of the surface to the adhesive. Tackifiers are usually low-molecular weight compounds with a high glass transition temperature. For example, tackifiers can be resins, such as rosin, terpenes, modified terpenes, aliphatic, cycloaliphatic and aromatic resins, $C_9$-aromatic resins, and $C_5/C_9$-aliphatic/aromatic resins, hydrogenated resins, terpene-phenol resins, or silicate resins.

The present invention is exemplified with respect to a toilet paper dispenser. However, this device is exemplary only, and the invention can be broadly applied to any rolled product. The forgoing examples and drawings are intended to be illustrative only, and not unduly limit the scope of the appended claims.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The following references are incorporated by reference in their entirety:

U.S. Pat. No. 4,759,510.
U.S. Pat. No. 5,494,218.
U.S. Pat. No. 5,582,362.
U.S. Pat. No. 5,785,274.
U.S. Pat. No. 6,405,972.
U.S. Pat. No. 7,416,153.
US20020017572.
US20070040059.
US20080203215.
US20100084503.
US20100140372.
US20100213303.
WO199825848.

What is claimed is:

1. A freestanding dispenser for a single rolled product which has a center bore, comprising:

a freestanding casing of appropriate size and dimensions to hold only one rolled product within the freestanding casing, said freestanding casing having a first wall, a second wall, a third wall, and a fourth wall, a top wall with a hole through which the rolled product can be drawn from the inside of the freestanding casing to the outside of the freestanding casing, and an open bottom opposite to said top wall;

said first wall having a first inner surface;

said second wall a second inner surface, wherein said second wall is opposite said first wall;

wherein said fourth wall is opposite said third wall;

a first fastening means disposed on said first inner surface of said freestanding casing;

a second fastening means disposed on said second inner surface of said freestanding casing, wherein said first fastening means is opposite said second fastening means; and an axle fastened to, and supported by, said first and second fastening means, wherein said axle can rotate when fastened.

2. The freestanding dispenser of claim 1, further comprising a first guide having a first channel extending from near the bottom of said freestanding casing to said first fastening means, and a second guide having a second channel extending from near the bottom of said freestanding casing to said second fastening means, such that said axle can removably slide through the open bottom of the freestanding casing along said first and second channels into said first and second fastening means.

3. The freestanding dispenser of claim 1, wherein said first and second fastening means comprise an indentation sized and shaped to receive said axle.

4. The freestanding dispenser of claim 1, wherein said axle is telescoping and is removable by contraction.

5. The freestanding dispenser of claim 4, wherein said axle comprises a spring.

6. The freestanding dispenser of claim 1, wherein said axle has a ridge near its end and is removable by insertion of a blade.

7. The freestanding dispenser of claim 1, wherein said axle has a sufficient diameter to substantially fill the bore of said rolled product.

8. The freestanding dispenser of claim 7, wherein said axle comprises at least three bowed members spanning the middle of the axle and sized to fill the center bore of said rolled product.

9. The freestanding dispenser of claim 7, wherein said axle comprises a foam sleeve sized to fill the center bore of the rolled product.

10. The freestanding dispenser of claim 1, wherein said axle comprises a fragrance-bearing component.

11. A freestanding dispenser for a single rolled product which has a center bore, comprising:

a freestanding casing of appropriate size and dimensions to hold only one rolled product within the freestanding casing, said freestanding casing having a first wall, a second wall, a third wall, and a fourth wall, a top wall with a hole through which the rolled product can be drawn from the inside of the freestanding casing to the outside of the freestanding casing, and an open bottom opposite to said top wall;

said first wall having a first inner surface;

said second wall a second inner surface, wherein said second wall is opposite said first wall;

wherein said fourth wall is opposite said third wall;

a first fastening means disposed on said first inner surface of said freestanding casing;

a second fastening means disposed on said second inner surface of said freestanding casing, wherein said first fastening means is opposite said second fastening means;

an axle fastened to, and supported by, said first and second fastening means, wherein said axle can rotate when fastened, wherein said axle is telescoping and comprises a spring, and wherein said first and second fastening means comprise an indentation sized and shaped to receive said axle;

a first guide having a first channel extending from near the bottom of said freestanding casing to said first fastening means on the first inner surface; and a second guide having a second channel extending from near the bottom of said freestanding casing to said second fastening means on the second inner surface, such that said axle can removably slide through the open bottom of the freestanding casing along said first and second channels into said first and second fastening means.

12. The freestanding dispenser of claim 11, wherein said axle has a ridge near its end and is removable by insertion of a blade.

13. The freestanding dispenser of claim 11, wherein said axle has a sufficient diameter to substantially fill the bore of the rolled product.

14. The freestanding dispenser of claim 13, wherein said axle comprises at least three bowed members spanning the middle of the axle and sized to fill the center bore of said rolled product.

15. The freestanding dispenser of claim 13, wherein said axle comprises a foam sleeve sized to fill the center bore of said rolled product.

16. A kit for forming a freestanding dispenser for a rolled product which has a center bore, the kit consisting of:

a freestanding casing of appropriate size and dimensions to hold only one rolled product within the freestanding casing, said freestanding casing having a first wall, a second wall, a third wall, and a fourth wall, a top wall with a hole through which the rolled product can be drawn from the inside of the freestanding casing to the outside of the freestanding casing, and an open bottom opposite to said top wall;

said first wall having a first inner surface;

said second wall a second inner surface, wherein said second wall is opposite said first wall;

wherein said fourth wall is opposite said third wall;

an axle;

a first fastening means disposable on said first inner surface of the freestanding casing;

a first guide having a first channel and being attached to said first fastening means, wherein the first guide has a bottom;

a first adhesive covering the backside of said first fastening means and said first guide;

a second fastening means disposable on said second inner surface of the freestanding casing, wherein said first fastening means is opposite said second fastening means when the kit is assembled;

a second guide having a second channel and being attached to said second fastening means, wherein the second guide has a bottom; and a second adhesive covering the backside of said second fastening means and said second guide, wherein said first and second fastening means comprise an indentation sized and shaped to receive said axle, and wherein said guides are shaped such that said axle can removably slide through the open bottom of the freestanding casing along said first and second channels into said first and second fastening means, such that said first and second fastening means support said axle, and said axle can rotate when fastened.

* * * * *